US005908361A

United States Patent [19]

Fisher et al.

[11] Patent Number: 5,908,361

[45] Date of Patent: Jun. 1, 1999

[54] AUTOMATED TENNIS LINE CALLING SYSTEM

[75] Inventors: Joseph R. Fisher, Sudbury; William C. Booth, Stow; Francis E. McInnis, Marlboro, all of Mass.

[73] Assignee: Signal Processing Systems, Inc., Sudbury, Mass.

[21] Appl. No.: 08/871,731

[22] Filed: Jun. 6, 1997

Related U.S. Application Data

[63] Continuation-in-part of application No. 08/587,776, Dec. 22, 1995, abandoned.

[51] Int. Cl.[6] ..... G08B 5/00

[52] U.S. Cl. ..... 473/467

[58] Field of Search ..... 473/467; 340/323 R

[56] References Cited

U.S. PATENT DOCUMENTS 3,774,194 11/1973 Jokay et al. ..... 473/467
3,982,759 9/1976 Grant ..... 473/467
4,365,805 12/1982 Levine ..... 473/467

FOREIGN PATENT DOCUMENTS

3835133 A1 4/1990 Germany .
4225109 2/1994 Germany .

*Primary Examiner*—George Manuel
*Attorney, Agent, or Firm*—Mark P. White

[57] ABSTRACT

A system is described for the automatic detection of ball bounces on a tennis court, and which is applicable to similar games. The system comprises a sonar-like sound system in conjunction with a pressure-sensitive system located on the court surface itself. The sound system uses a multiplicity of microphones to detect and means to analyze the sounds and to calculate the position of sounds identified as balls striking the court surface. The pressure system is used to detect ball bounces on the boundary lines themselves, and utilizes coaxial cables as the sensing elements. The pressure system is checked only when the sound system determines that a ball is bouncing on or near one of the boundary lines. Processing is done by a personal computer to which a special interface card is added.

67 Claims, 11 Drawing Sheets

AUTOMATED TENNIS LINE CALLING SYSTEM

This application is a continuation-in-part of pending application No. 08/587,776 filed on Dec. 22, 1995, now abandoned.

BACKGROUND OF THE INVENTION

1. Field of the Invention

The present invention relates to systems for determining the location of a ball striking a court or playing field, and more particularly to systems to determine whether a ball is in or out of play.

2. Description Relative to the Prior Art

Numerous systems for calling lines in tennis and other court games have been devised over the years, but the task is inherently difficult and the performance of such systems has been disappointing. Of the various systems designed for tennis only the "Cyclops" system is in routine use at major tennis tournaments. The Cyclops calls the back service line only and uses light beams crossing the court. As a result it can be used only in singles matches and must be enabled manually before the serve and disabled after the serve to prevent the annoyance of irrelevant service line calls when a ball or player breaks the light beam during play.

To call all lines, all of the time, is a very difficult problem. First of all, line calling requires a very high degree of precision. Professional linesmen are expected to make line calls with a precision of a fraction of an inch while a ball traveling at over 100 miles per hour traverses the width of a court boundary line in a thousandth of a second.

Secondly, systems which attempt to locate ball bounces must avoid being confused by many possible sources of interference. Systems which operate by sensing contact with the court must distinguish between ball bounces and the impact of players' feet and racquets. Systems which operate by tracking the ball must not be distracted by players running between the ball and the sensing device(s).

Thirdly, which of the court boundary lines are relevant changes during play. During the serve, the relevant boundaries are those of one of four service boxes for ball bounces and the opposite baseline for foot faults. But during play, only ball bounces outside the (singles or doubles) court boundaries, double bounces, double hits and net-cord touches by players are relevant. The service boxes are irrelevant as are the positions of players' feet and net-cord touches by the ball.

The capability required in an automatic line calling system depends on the circumstances of its use. At a supervised tournament, such a system can be merely an aid to the chair umpire and line calling staff. The chair umpire, who keeps the score, knows which are the relevant boundaries at each moment of play and can control the system to monitor only those relevant boundaries. This level of manual control is impractical, however, with unsupervised (e.g., club and home court) play. Players can't stop after a successful serve to instruct the line calling system to stop monitoring the service lines and instead to monitor the doubles (say) lines. Consequently, to be applicable to unsupervised play, any line calling system must be able to keep track of the state of play and thus to keep score, without human intervention, except possibly for some rarely occurring situations. Systems for automatically calling lines in tennis matches have been sought after for many years.

Although there are many other games which require a determination of whether a ball is in or out of play, tennis presents a unique problem in that such a determination must be made every time a ball is struck by a player. Furthermore, the ball speeds in tennis, often in excess of 100 miles per hour, make judging lines more difficult than in most other games. In some cases a single call can be the difference between winning and losing, and, in a professional tournament, this could be a difference of several hundred thousand dollars in prize money.

And finally, a thoroughly officiated tennis match requires eleven officials, consisting of ten linesman and the umpire, all of whom have the responsibility of calling lines.

The burden of providing a full complement of officials is great enough that even in the professional ranks games are often played with less than the full complement of officials. In tennis tournaments conducted at regional and local levels, it is common to have the players call their own lines throughout the tournament except during the finals. Even at the club and recreational level the calling of lines presents a source of friction among the players, and negatively effects their enjoyment of the game.

As previously stated, only "Cyclops" is currently in common use, appearing at the highest-level tournaments, including the "Big Four": Wimbledon, the U.S. Open, the French Open, and the Australian Open. Cyclops suffers from a number of shortcomings, however. First of all, it is expensive, being leased for $20,000 per system for two weeks of use. Secondly, Cyclops can only be used to call service lines, and only in singles matches. It cannot distinguish between a ball in flight and a player. Thus, it must be shut off immediately after each serve.

Furthermore, Cyclops is often accused by the players of being inaccurate, and players frequently ask that Cyclops be turned off during a match.

The prior art may be divided into several categories: first, the light-sensor types, such as Cyclops, which has the problem of high inherent cost, requirements of delicate alignment, and which can be rendered inoperable by the presence of players blocking the light beam. Included in this type is Chen, U.S. Pat. No. 4,004,895; Carlton, U.S. Pat. No. 4,867,449 and U.S. Pat. No. 5,303,915.

Next are the pressure-sensitive types, which require pressure-sensitive devices to be embedded in the court, and which generally cannot distinguish between ball bounces and other pressure on the court, including pressure created by the players' movements. Typical of this class is Levine, U.S. Pat. No. 4,365,805.

Then there are the types which require electrically-conductive balls, and which require a network of electrical circuits on the surface of the tennis court itself which sense the presence of the conducting ball which makes circuit connections upon contact. Typical of these is the Van Auken patent, U.S. Pat. No. 4,109,911, and Supran, U.S. Pat. No. 4,432,058.

Finally there are other assorted systems, including the radar systems, such as Nuttall, U.S. Pat. No. 5,138,322, and including the electromagnetic field-sensing systems, such as Candy, U.S. Pat. No. 5,303,915. These are inherently very expensive, and, as in the other types of systems, have difficulty distinguishing between the various types of objects detected.

None of the above systems (with the possible exception of those using pressure sensing) has the slightest possibility of matching the accuracy possible with a clay court where in/out calls can be made (albeit after the fact) by careful inspection of the mark left by the partially compressed and rolling or skidding ball when hitting the court. Further, none (with the possible exception of the radar approach of Nuttall) has the possibility of providing fully automatic operation, because the correct area of the court in which the ball must bounce changes continually in response to events which they don't even attempt to sense, viz., players' racquets hitting the ball.

In contrast to the previous inventions the current invention combines two types of sensors: pressure sensors along the court boundary lines and multiple microphones around the periphery of the court. Whereas, properly designed pressure sensors can provide a very strong signal when hit by a ball and no signal for a miss (even a fraction of a centimeter away), it is difficult or impossible to distinguish (based on the pressure sensor signal alone) whether the sensor signal was caused by a ball hit or some other event or by even electrical interference.

On the other hand, the sound of a ball bounce as picked up by a microphone is very distinctive and by measuring the time of arrival of this distinctive sound at a multiplicity of microphones, a good—but not precise—estimate of the location of the ball bounce and, equally importantly, of the time of the bounce (to within a few milliseconds) can be made. When the location of the ball bounce is not very close to a court boundary, the microphone signals alone can be used to determine if the ball was in or out, but if the bounce is very close to the boundary line, the pressure sensor signals are also used but only during the brief instant of time when (based on the estimated time of the bounce) the ball might have hit the pressure sensor. Thus the problem of excluding irrelevant signals from the pressure sensors is solved, not by analysis of the pressure signal itself, but rather by inspecting the pressure sensor signals at such short and infrequent times that the probability of a coincident interfering signal is negligibly small.

The current invention solves all of the problems inherent in the prior art. First of all, it is inherently inexpensive to produce. It utilizes commonly available products: coaxial cables to serve as pressure transducers, commercially available microphones as sound detectors, and commercially available loudspeakers as sound generators and alarms. It should be noted, however, that the term "coaxial cable" is used here to indicate a cable comprising a conductive outer shield, a dielectric, and one or more center conductors surrounded by the dielectric. The outer shield likewise completely surrounds the dielectric. Coaxial cables, as used in the context of this invention, include not only the commonly used type whose cross section comprises concentric circles, but flattened cables having a width of several inches, and a thickness measured in thousandths of an inch.

Only a single, custom-designed circuit board together with a computer interface board is required to allow input of the signals from the microphones and pressure transducers into a personal computer, and to allow the personal computer to generate signals to drive the loudspeakers.

Furthermore, the current invention is able to distinguish among ball bounces on the court, balls striking the net, balls hitting racquets, and to overlook players moving around the court and other background sounds.

The current system is equally applicable to the hard surfaces currently popular, including asphalt, concrete, and composition courts, to carpet-like surfaces, as well as to granular surfaces, such as clay, Har-Tru, terre-battue, and other related materials.

Because the current system is able to accurately locate the position of the ball as it strikes the court each time and to detect and recognize other relevant events, such as a player's racquet hitting the ball, the system provides for automatic scoring capability.

And finally, the current invention provides for statistical collection of ball bounces, location of racquet hits, ball speed, etc. to be used as a training aid.

According to one aspect of the current invention, coaxial cables are placed in intimate contact with the several boundary lines of the tennis court. These cables may be buried in the court beneath the boundary lines, or may be attached to the lines themselves, where the lines are provided in rolls of plastic or canvas materials.

According to yet another aspect of the invention, coaxial cable pressure sensing devices may be placed just outside of the court boundary lines to increase the area of the court instrumented with pressure sensing devices and thus to increase the reliability of in/out decisions.

According to another aspect of the invention, a multiplicity of microphones is provided around the periphery of the tennis court. These microphones sense sounds caused by the hitting of the tennis ball with a variety of objects, as well as with the ground.

According to still another aspect of the invention, the electrical signals produced by the microphones are analyzed and filtered so that only ball bounces on the court, racquet hits and net-cord hits are provided to the computation system.

According to yet another aspect of the invention, the time delays of signals arriving at several pairs of microphones and arising due to a ball bounce, racquet hit or net-cord hit are accurately determined, and these time delays are processed by a computation device to precisely locate the ball anywhere on the court or proximate surrounding area to within an error less than the width of the standard court boundary lines.

According to yet another aspect of the invention, a multiplicity of loudspeakers is provided directly adjacent to the microphones to provide for calibration of the sound system to take into account variations in transmission time of sounds through the air due to temperature and wind conditions.

According to yet another aspect of the invention, the output of the coaxial cables is considered only when the sound system calculates that the ball has hit the court very close to one of the boundary lines so that false indications of ball contact cannot be induced by players' feet and other disturbances except by coincidence during very brief instants of time.

According to another aspect of the invention, the pressure sensing devices are adjusted to have a contact sensitivity closely approximating the sensitivity of a clay court to marking by an impacting ball.

According to another aspect of the invention, the approximate location provided by the microphone information is used together with the precise contact information provided by the contact sensors to make an automatic determination in real time and to a precision equivalent to checking the mark on a clay court as to whether each ball bounce is in or out.

According to yet another aspect of the invention, contact with the net by a ball or a player is sensed by a pressure sensitive device or devices attached to the net.

According to yet another aspect of the invention, foot faults are detected by comparing a) the time of occurrence of signals induced by contact of a serving player's foot acting on a pressure sensor associated with the court baseline with b) the computed time of occurrence of racquet contact with the ball as derived from the racquet sounds received by three or more microphones.

According to yet another aspect of the invention, the sequence of locations of ball bounces, net-cord hits, service foot faults and racquet hits (the first three of which may be confirmed using signals from the pressure sensing devices) and resulting in/out calls are used to monitor the progress of play and to keep score.

According to a final aspect of the invention, the sequence of precise times and locations of ball bounces, net-cord hits, racquet hits and service foot faults is stored and used to provide replay of the match and/or to compile statistics of player performance such as ball speed (both on serves and otherwise), numbers of winners (unreturned hits), errors (hits which go out) and other measures of player accuracy and effectiveness.

SUMMARY OF THE INVENTION

According to one aspect of the invention, an apparatus for automatically calling tennis lines is disclosed. The invention determines whether a ball is in or out of play by means of a multiplicity of elongated pressure-sensitive devices located parallel to, and in proximity with the boundary lines. The invention also discloses a multiplicity sound-sensitive devices spaced around the periphery of the field of play. Electrical signals produced by these devices are fed into a processing system which combines the two types of signals and processes them to determine the location of the ball. Finally, a device is provided to notify the players as to whether the ball is in or out of the field of play.

According to another aspect of the invention, microphones and coaxial cables are utilized as the sound-sensors and pressure sensors, respectively.

According to yet another aspect of the invention, signal analysis is used to analyze the sounds received by the microphones to determine whether the sounds represent the ball striking the court, balls striking the racquet, or otherwise.

According to still another aspect of the invention, interferometric means are used to determine the location of the sound source detected by the microphones based on the time delays in reception of the sound signals between various microphones.

According to a further aspect of the invention, pressure sensors are affixed to the net to detect net cord hits.

According to a yet-further aspect of the invention, the pressure sensors are used in the calculation of ball hits only when the sound-detection system determines that the ball has bounced in proximity to a boundary line.

According to a final aspect of the invention, a personal computer is used to perform the functions of signal analysis, interferometric calculations, calculation of location and identification of sound sources, automatic scoring, statistical analysis of the data collected, calibration of the system, and notification of the players of game progress.

BRIEF DESCRIPTION OF THE DRAWINGS

These, and further features of the invention, may be better understood with reference to the accompanying specification and drawings depicting the preferred embodiment, in which.

DETAILED DESCRIPTION OF THE PREFERRED EMBODIMENTS

Figure 1:
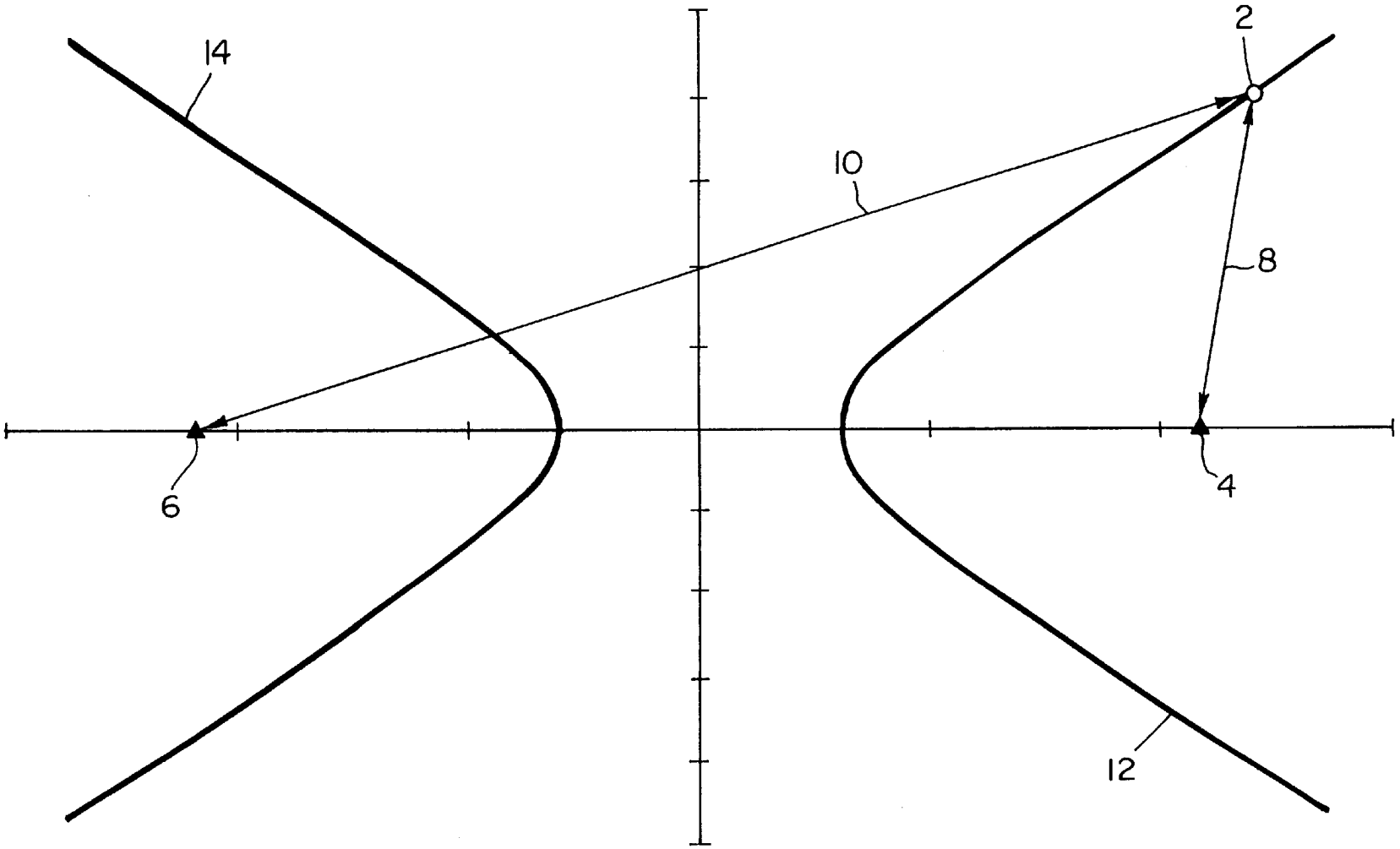
FIG. 1 depicts the hyperbola which describes the locus of all points which can produce a given time delay between arrival times of a sound observed at two microphones.

FIG. 1 illustrates the general principle of the use of sound detectors to localize a sound source. In FIG. 1 the sound source 2 is located a distance 8 from the first microphone 4, and a distance 10 from the second microphone 6.

Assuming that the speed of sound is constant at $v_1$, the time required for the sound to reach the first microphone is $$t_1=d_1/v_1 \quad (1)$$

and the time required for the sound to reach the second microphone is $$t_2=d_2/v_1 \quad (2)$$

where $d_1$ is the distance from the sound source to the first microphone 4, and $d_2$ is the distance from the sound source to the second microphone 6.

With the distances depicted in FIG. 1, the sound will thus reach the second microphone at a time $\Delta_{21}$ later than it reaches the first microphone, where $$\Delta_{21}=t_2-t_1=(d_2-d_1)/v_1 \quad (3)$$

Thus, the time difference $\Delta_{21}$ is proportional to the difference between the distance from the sound source to the first microphone, and the distance from the sound source to the second microphone.

It is well known that a hyperboloid forms the locus of all points having a constant difference in distance from two fixed points. In the instant case, the two fixed points, the foci of the hyperboloid, are the locations of the microphones which are assumed to be known exactly. When the event to be located (i.e. the ball bounce) is known to be in the same plane (i.e. the court surface) as the microphones, then the problem reduces to the two-dimensional plane of the court, which intersects the hyperboloid in a hyperbola. The hyperbola is described by the equation:

$$x^2/a^2-y^2/b^2=1 \quad (4)$$

And the foci of the hyperbola, located at the microphones, are at locations (±c,0), where a=one-half the difference in time of arrival ($\Delta_{21}$ above) and $$c^2=a^2+b^2 \quad (5)$$

Thus, if all that is known is the difference in times of arrival at the two microphones, the sound source can be anywhere on the above hyperbola, although by determining at which microphone the sound first arrives one lobe or the other of the hyperbola can be discarded. By adding a third microphone two additional time delay differences may be calculated, and two additional hyperbolae constructed.

Figure 2:
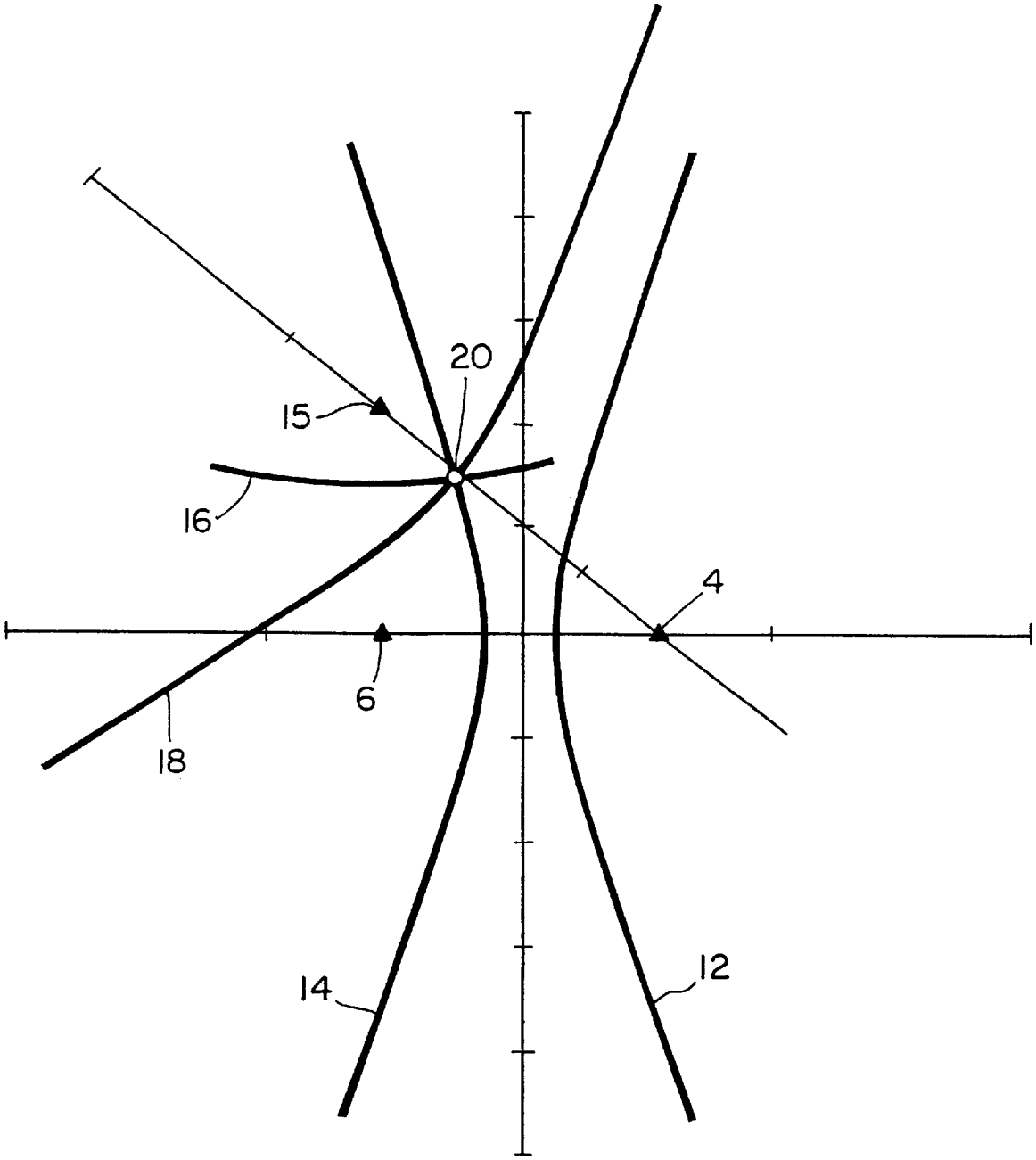
FIG. 2 depicts the use of three microphones to determine the exact location of a sound which produces three different time delays by interferometry.

FIG. 2 shows a third microphone 15 added to the first two. The third microphone 15, provides for the measurement of two additional time delays, $\Delta_{31}$ and $\Delta_{32}$, which, by following the same arguments as above allows us to locate the sound source along a second and third hyperbola 16 and 18. If the microphones are not all on the same line then the three hyperbolae intersect at a single point 20, and the sound source must be located at this point.

The technique of using time delays in this manner to determine the location of the sound source is referred to as interferometry. The technique is well known, and is similar to optical measurement techniques which use the phase of signals arriving at different detection points as a measure of the delay.

Figure 3:
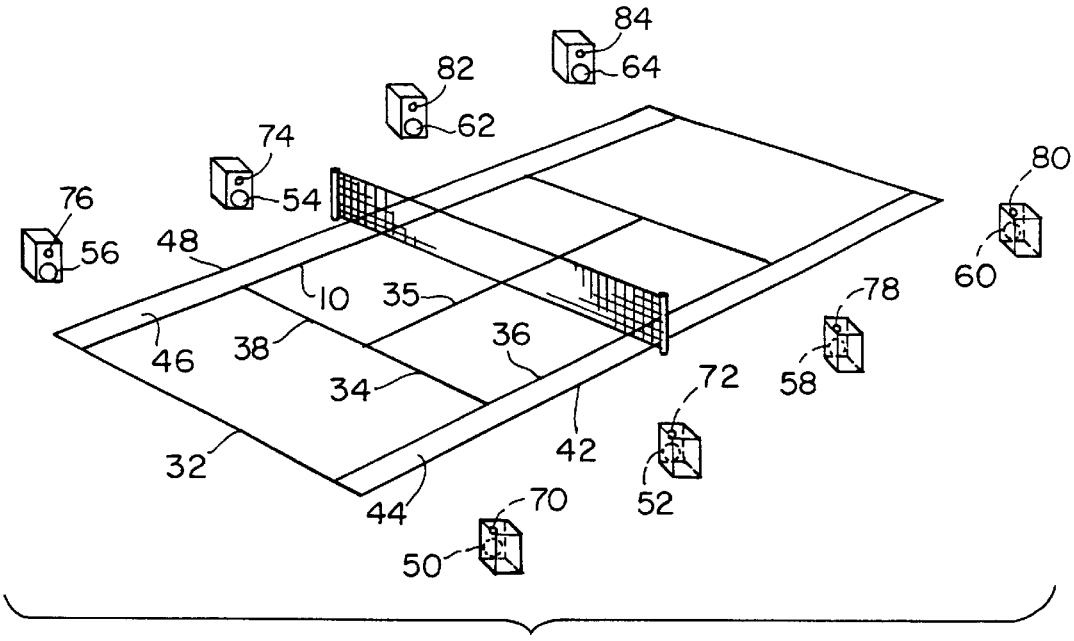
FIG. 3 depicts an isometric view of the preferred embodiment, and shows a tennis court with eight sets of microphone-loudspeaker combinations spaced around the periphery of the court.

In the preferred embodiments reference is made to the following boundary lines of a standard tennis court, as shown in FIG. 3: the base line 32 is the line farthest from the net and runs parallel to the net; the deuce court service line 34 is about half-way between the net and the base line, and extends from the center line 35 to the deuce court side line 36. The ad court service line 38 is a continuation of the deuce court service line from the center line to the ad court side line 10; the deuce court doubles line 42 extends from the plane of the net to the base line 32, and is parallel to the deuce court side line 36, enclosing the deuce court alley 44; and finally the ad court doubles line 48, extends from the plane of the net to the base line 32, enclosing the ad court alley 46. These definitions are those of the rules of tennis, and do not necessarily correspond to the segments of line disclosed in the current invention.

In FIG. 3 the names of the boundary lines are prefaced with the word "near" for the side of the court nearest the viewer, and "far on the other side of the net".

Figure 4:
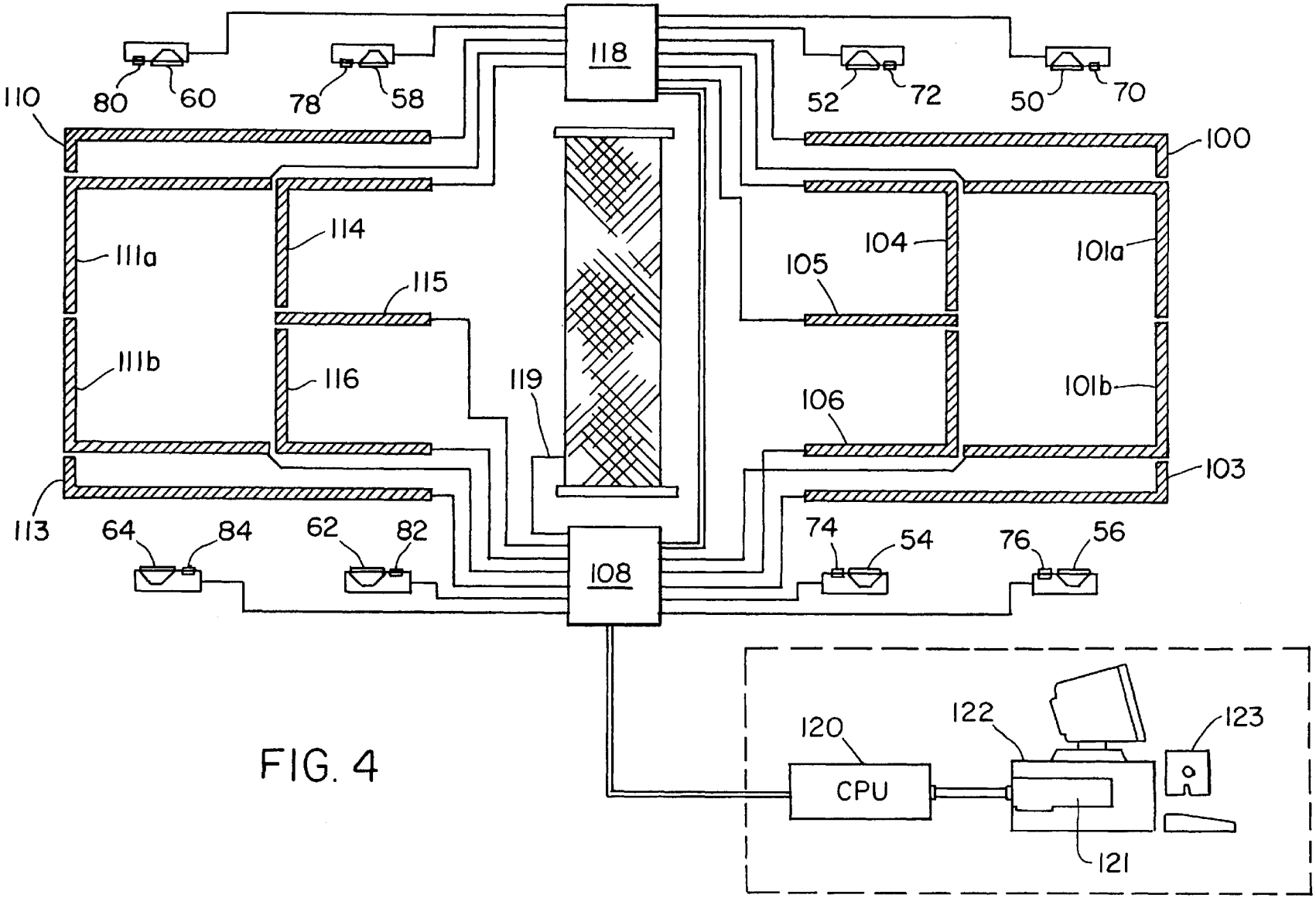
FIG. 4 depicts a block diagram showing all the components of the preferred embodiment of the invention.

The system may be best understood by referring to the block diagram of FIG. 4, which shows the individual subsystems comprising the invention, together with the interconnections between said subsystems.

The preferred embodiment as it appears in FIG. 4 comprises eight loudspeakers 50, 52, 54, 56, 58, 60, 62, and 64 spaced more or less as shown in FIG. 3, each speaker being located in close proximity to each of eight microphones 70, 72, 74, 76, 78, 80, 82 and 84, respectively.

In FIG. 4, the near-court microphones 70, 72, 74 and 76, the near-court pressure sensing cables 100, 101, 102, 103, 104, 105 and 106, and the near court loudspeakers 50, 52, 54, and 56, are individually connected to either cable concentrator box 108 or 118, which provide a junction from which the cables are routed to the signal processing unit 120.

Similarly, the far-court microphones 78, 80, 82, and 84, the far-court pressure sensing cables 110, 111, 112, 113, 114, 115 and 116, the far court loudspeakers 58, 60, 62, and 64, and the net pressure sensor, 119, are individually connected to either cable concentrator box 108 or 118. Pressure sensing coaxial cables 100,101(*a* and *b*), 103,104,105 and 106 in one half court and 110,111(*a* and *b*), 113,114,115 and 116 in the other half court are laid in intimate contact with the court boundary lines of FIG. 3. These cables also connect through one or the other of the cable concentrator boxes 108 or 118.

Each microphone and pressure sensing cable (including the net-cord sensor) is routed to the nearest cable concentrator.

The net-cord sensor is used as part of the service detection system. A serve which touches the net is "out" if it lands outside the service box, and a "let" to be re-played if it lands inside the service box. Each service box is bounded by the service line on one end, the net on the other, the center line on one side, and a sideline on the other side.

The signal processing unit 120 conditions, filters and digitizes the various electrical signals generated by the various elements described above. The digitized signals are then sent to the computer interface 121, which is a printed circuit card inserted into one of the expansion slots of a standard personal computer 122.

The computer by means of a computer program 123 uses the signals thus collected to calculate the position of the tennis balls as they strike various object on and off the court.

In operation the system is self calibrating to compensate for changes in wind and temperature, which have an effect of varying the speed of sound. The calibration is done from time to time by emitting sound waves from each loudspeaker in turn, and measuring the time it takes the sound to reach each of the other microphones.

The line calling system will be described in terms of five major functional subdivisions: 1) the line/cable subsystem, 2) the microphone subsystem, 3) the speaker subsystem, 4) the computer subsystem and 5) the control/display subsystem. The system can operate in several modes ranging from providing only advice to line judges and chair umpire to fully automatic operation with infrequent human intervention. The subsystems function as described in the following sections.

Line/Cable Subsystem

The Line/Cable Subsystem consists of one or more coaxial electrical cables embedded in or run along in close proximity to each of the boundary line segments of the court, as well as one or more cables attached to the net.

It is well known that coaxial cables made with commonly used dielectrics generate a voltage when struck. Although this is believed to be a result of the well-known piezoelectric effect, there may be other contributing phenomena. Regardless of the exact physical principle causing the voltage, throughout this document, the induced voltage will be referred to as "piezoelectric". In the current application such a cable forms a pressure sensor which generates an electrical pulse when touched by a ball but generates little or no signal when a ball hits the court nearby—even a fraction of a centimeter away. The cables located along the net are used to detect touching of the net by the ball or a player. In alternative embodiments more sensitive cables, e.g., made with a polarized polyvinylidene fluoride dielectric, are used for the net-cord sensors.

Figure 5:
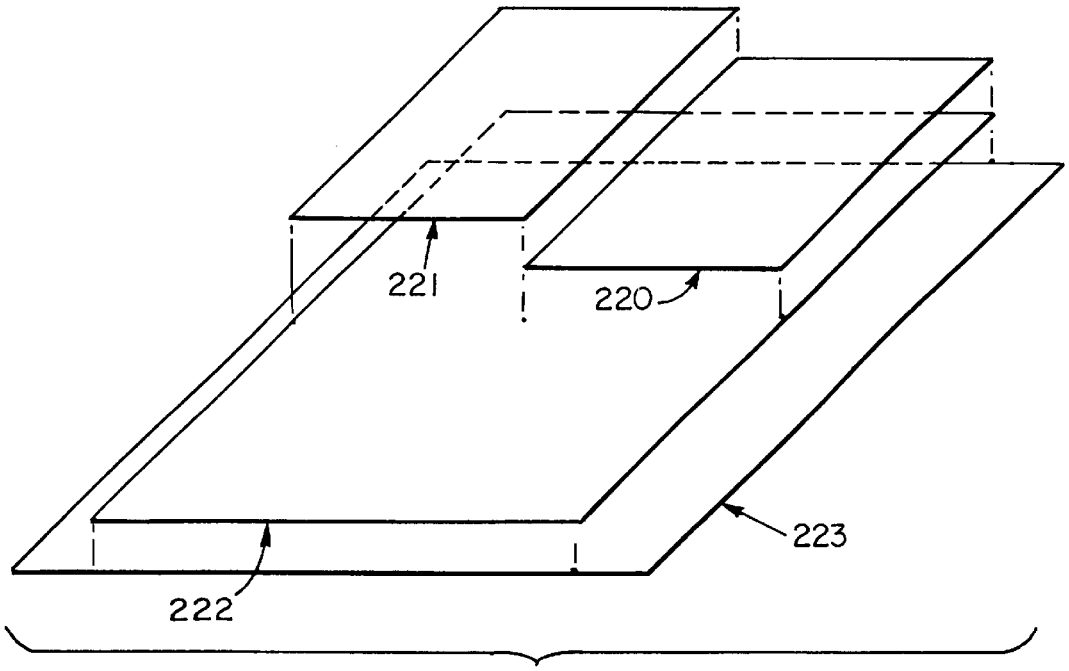
FIG. 5 depicts the four boxes on a half court which the court boundary line circumscribe.

The boundary lines on the court can be considered to divide the court into "boxes". There are four such boxes on each side of the net: the deuce service box 220, the ad service box 221, the singles box 222 and the doubles box 223 as shown in FIG. 5. Only one of the latter two boxes is used during any match according to the type of match being played. The boundary lines circumscribing any box are part of the interior of the box so that a ball touching such a line is considered to be "in" and only a ball hitting outside the box and not touching any part of a boundary line is considered to be "out". Note that the two service boxes on the same side of the net overlap because they are bounded, in part, by the center line which is in the interior of both such boxes. Similarly both such service boxes are in the interior of the singles box and all three of the aforementioned boxes are in the interior of the doubles box. Further note that all boxes have the line of the net as a boundary. Although these boxes overlap, only one is relevant (is the correct location for the ball to bounce) at each instant of play. At any stage of play, to be considered to be "in" the ball, when bouncing, must hit within the outer edge of the proper one of such boxes. Starting with the serve, the ball must hit within the proper service box and then be returned to the proper playing box (either singles or doubles) on the opposite side on the net and after being hit there must return to the corresponding playing box on the first side on the net. The play continues in this way such that, with each hit of the ball by the racquet of a player on the side of the currently relevant box, the relevant box immediately changes to the opposite side of the net. The line of the net requires special consideration because, unlike the other boundaries where the ball can hit largely outside of the box and still be "in" by virtue of slight contact with the boundary line, the barrier of the net constrains the ball to be entirely on one side of the net or the other. Moreover, even when the net has been moved by the force of impact of the ball, the ball is considered to be in a box on that side of the net to which the ball last crossed while still in play. At each place on the court where two of the above described boxes overlap, the joining boundary lines appear to form a "T", but the contact sensors must provide for determining if the ball bounce is "in" with respect to each such box independently. Thus at such overlap points, boundary lines which are continuous for human visual discrimination must be subdivided or segmented for automatic sensing.

The contact sensors of this invention are used to synthesize "in-sensors" which instrument some portion of the area of the box. The signals generated by such in-sensors indicate that the ball hit some portion of the box and therefore is "in". In alternate embodiments, contact sensors are used to synthesize both in- and out-sensors. Signals from "out-sensors" are used to indicate that the ball hit some portion of the court outside of the box and therefore is "out" unless the adjacent in-sensor was contacted simultaneously. Used together in- and out-sensors can extend the region of the court surface which provides a positive confirmation of a ball strike and thus reduce the location estimation accuracy required from the microphone subsystem.

Figure 6:
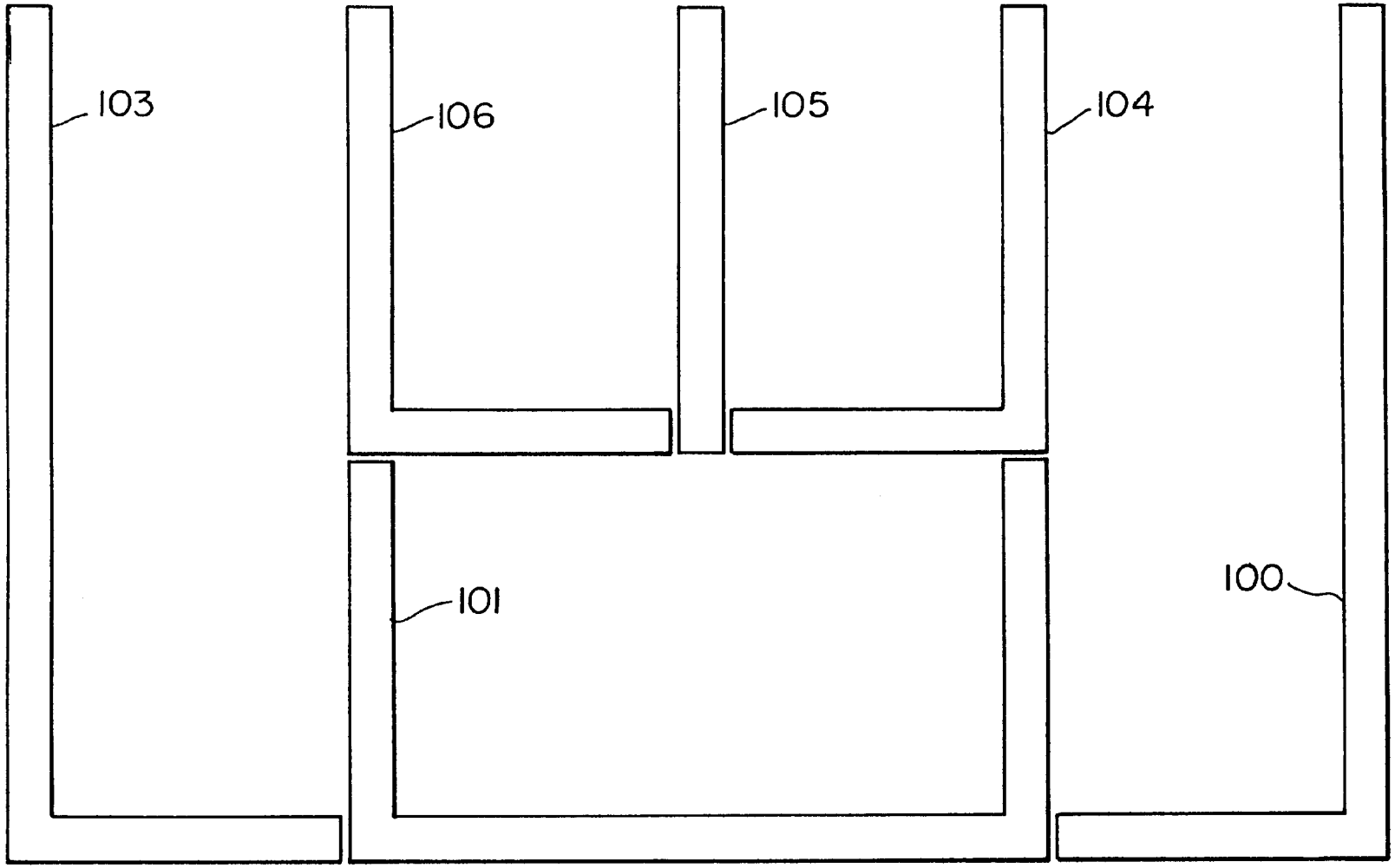
FIG. 6 depicts the arrangement of pressure sensors on one-half of a standard tennis court when such sensors are used to detect "in" bounces.

The effective region of contact sensing of an in-sensor must lie entirely within the interior of the box being instrumented and must extend out to the edge of the boundary lines of said box, but the degree to which such in-sensor extends into the interior of said box is not constrained, that is to say, in-sensors must be substantially congruent with segments of the visually apparent boundary marking on the court but may be wider. FIG. 6 shows the minimum number of segments in one-half court using in-sensors. Further subdivision or segmentation may be incorporated for convenience of installation or to further reduce the already low probability that a player's foot might touch the line segment at the same instant that the ball hits the court near said line segment. Segments 100 and 103 comprise the ad-court and deuce court doubles lines and the two ends of the base line. Segment 101 comprises part of the ad court and deuce court side lines and the rest of the base line. Segment 106 comprises the rest of the ad-court side line and the ad court service line. Segment 105 comprises the center line, and segment 104 comprises part of the deuce court side line and the deuce court service line. The near-court arrangement shown is repeated in the far court. The undivided singles base line segment 101 of FIG. 6 is segmented in FIG. 4 into two halves 101*a* and 101*b*.

The effective region of contact sensing of an out-sensor must lie entirely outside of the box to be instrumented and may approach the edge of the boundary lines of said box, but if any such out-sensor extends closer to the boundary of said box than the maximum size of the area of contact of the ball, then said out-sensor can be used only in conjunction with the adjacent in-sensor;, i.e., if contact is sensed by the out-sensor, then the ball is "out" if and only if no contact was sensed simultaneously by said in-sensor.

Figure 7:
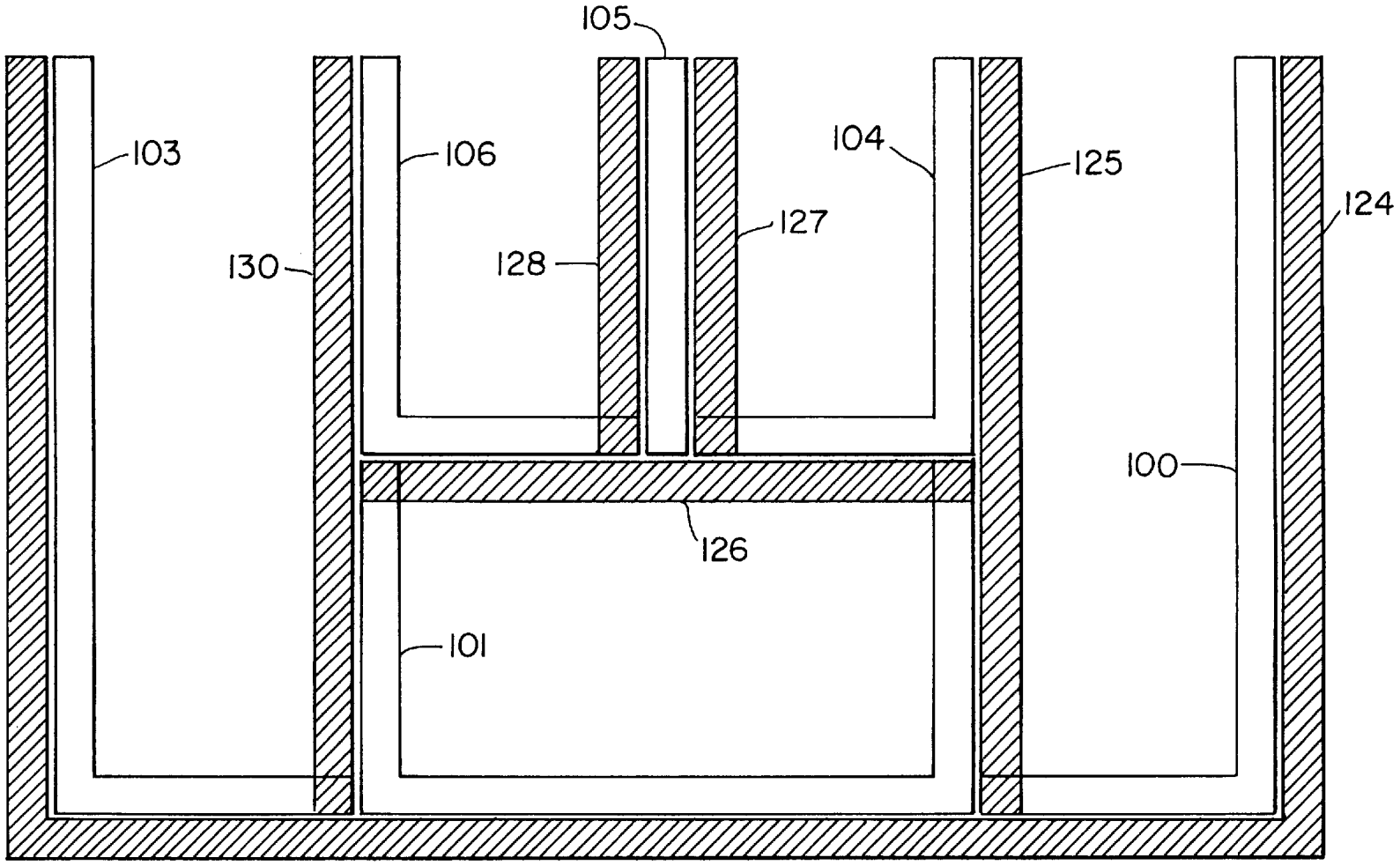
FIG. 7 depicts the arrangement of pressure sensors on one-half of a standard tennis court when such censors are used to detect both "in" and "out" bounces.

FIG. 7 shows the locations of both the minimum set of out-sensors 124, 125, 126, 127, 128, and 130 and in-sensors for those embodiments which use out-sensors. It is interesting to note that linesmen act as out-sensors achieving an unsegmented view along a boundary line and calling a ball "out" unless contact with a boundary line is perceived.

Note that there is no inconsistency where these out-sensors overlap with in-sensors, e.g., where out-sensor 125 overlaps with in-sensor 100 because in-sensor 100 is "in" for doubles play only and is "out" for singles as is out-sensor 125. In fact in some embodiments in-sensor 100 and out-sensor 125 may comprise different parts of the same coaxial cable. Similar considerations apply to the other places where in-sensors and out-sensors overlap.

Like in-sensors, out-sensors are segmented to provide differentiation between different portions of the visually continuous box boundaries, and for convenience of installation or to further reduce the already low probability that a player's foot might touch the out-sensor at the same instant that the ball hits the court near said line segment.

Two types of tennis courts are most commonly used: 1) clay courts, which are made of compacted dirt, often with a loose granular top layer, such as Har-Tru (TM) and 2) hard courts, which are made of asphalt, compounded material, or concrete, usually with a heavy painted surface coating. On clay courts the boundary lines are cloth or plastic tape which is nailed in place. On hard courts the boundary lines are painted. There also exist other, less common, court surfaces. Among these are grass and carpet-like surfaces, including TerraFlex™, Supreme Court™ and the like. The current invention is applicable to most of these other surfaces as well. A special form of carpet-like surface is used in "team tennis" which surface has no white boundary line markings but rather adjoining boxes are made with contrasting surface colors. When applied to this type of surface, the term boundary line as used in this disclosure means the narrow joint between two adjacent colored areas.

In the case of a clay court in-sensors are fabricated by bonding a piezoelectrically active coaxial cable to standard cloth or plastic boundary tape. The tape conducts vibrations from a ball impact to the cable so that, if a ball hits either the cable directly or anywhere on the tape, a strong signal is generated in the cable.

Figure 8C:
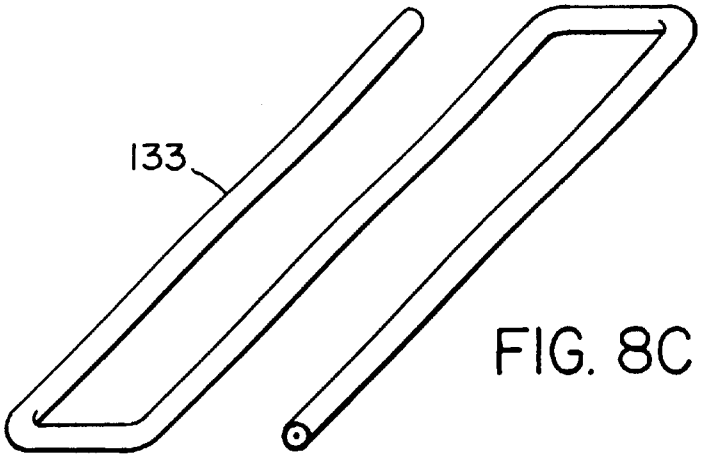
FIG. 8*c* depicts an isometric view of a pressure-sensor cable folded in accordion-pleats to provide coverage of the entire width of a boundary line.
Figure 8D:
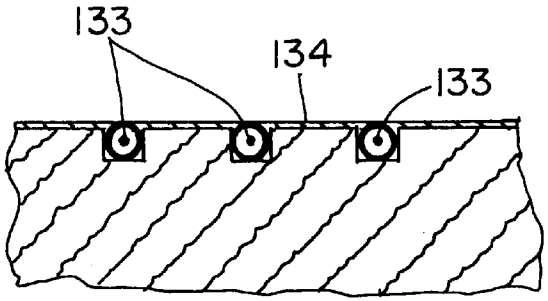
FIG. 8*d* depicts a cross-section view of the pressure-sensor cable folded in accordion-pleats and embedded in the court beneath a boundary line.
Figure 8A:
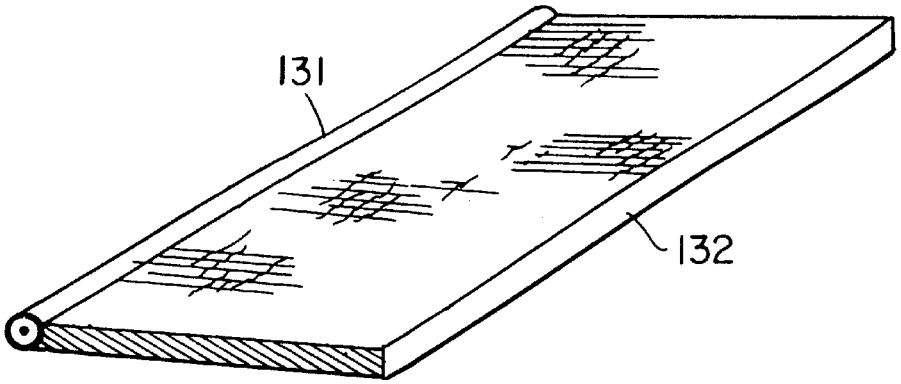
FIG. 8*a* depicts an isometric view of a coaxial-cable-type pressure sensor bonded to a boundary line tape.
Figure 8B:
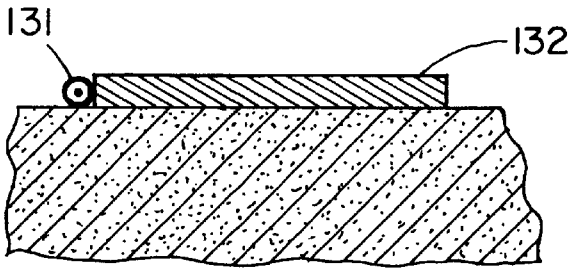
FIG. 8*b* depicts a cross-section view of a coaxial-cable-type pressure sensor bonded to a boundary line tape.

FIGS. 8*a* and 8*b* show the bonding of the coaxial cable 131 to the boundary tape for use with a clay court. The tape 132 is approximately 2 inches in width. The cable 131 is bonded to the edge of the tape. Bonding provides the intimate contact required to insure that the pressure wave generated in the tape when a ball strikes is conducted to the cable.

For other (than clay) types of courts, the area sensitivity equivalent to the tape is achieved by using a number of parallel lengths of cable spaced roughly one inch apart or, by preference, a single longer cable 133 laid in parallel folds as shown in FIG. 8*c* and laid in shallow grooves cut into the court as shown in FIG. 8*d* and then covered with line paint 134. This arrangement takes advantage of the fact that the ball contacts an area or spot rather than just a point.

Upon hitting the court a ball both compresses and continues in horizontal motion, (skidding and/or rolling) so that it touches an elliptical area having its major axis oriented along the direction of horizontal motion of the ball. If the ball has fallen from at least the three foot height of the net, then the minor axis of the contact ellipse is more than an inch and, depending on the horizontal speed, the major axis is at least one inch and may be up to four or five inches.

The one inch spacing between cables is less than the minimum contact area of a ball which has fallen from at least the height of the net and assures that the sensor will detect any ball hitting within the instrumented area or on either side of the area in such a location that the elliptical spot of contact touches the sensor.

The choice of the number of cable folds per boundary line segment depends on other details of the system and environment, specifically the accuracy of the microphone subsystem in locating ball bounces and the desired level of human interaction.

Although any number of parallel in-cables could be placed inside the box boundary, and any number of out-cables could be placed outside the box boundary. In practice it is unnecessary to place cables more than a few inches from the boundary because, if a ball bounces farther from the boundary, the microphone system and/or the judgment of players or line judges can be trusted to determine if the ball was "in" or "out".

A third type of in-sensor is made of a specially shaped coaxial cable which is flattened to be very thin and is wide enough to cover the width of the standard court boundary line. This type of coaxial cable is thin enough to be unnoticed when bonded directly to the bottom surface of a standard clay court boundary tape or when bonded to a hard court and covered with standard line paint.

Figure 9:
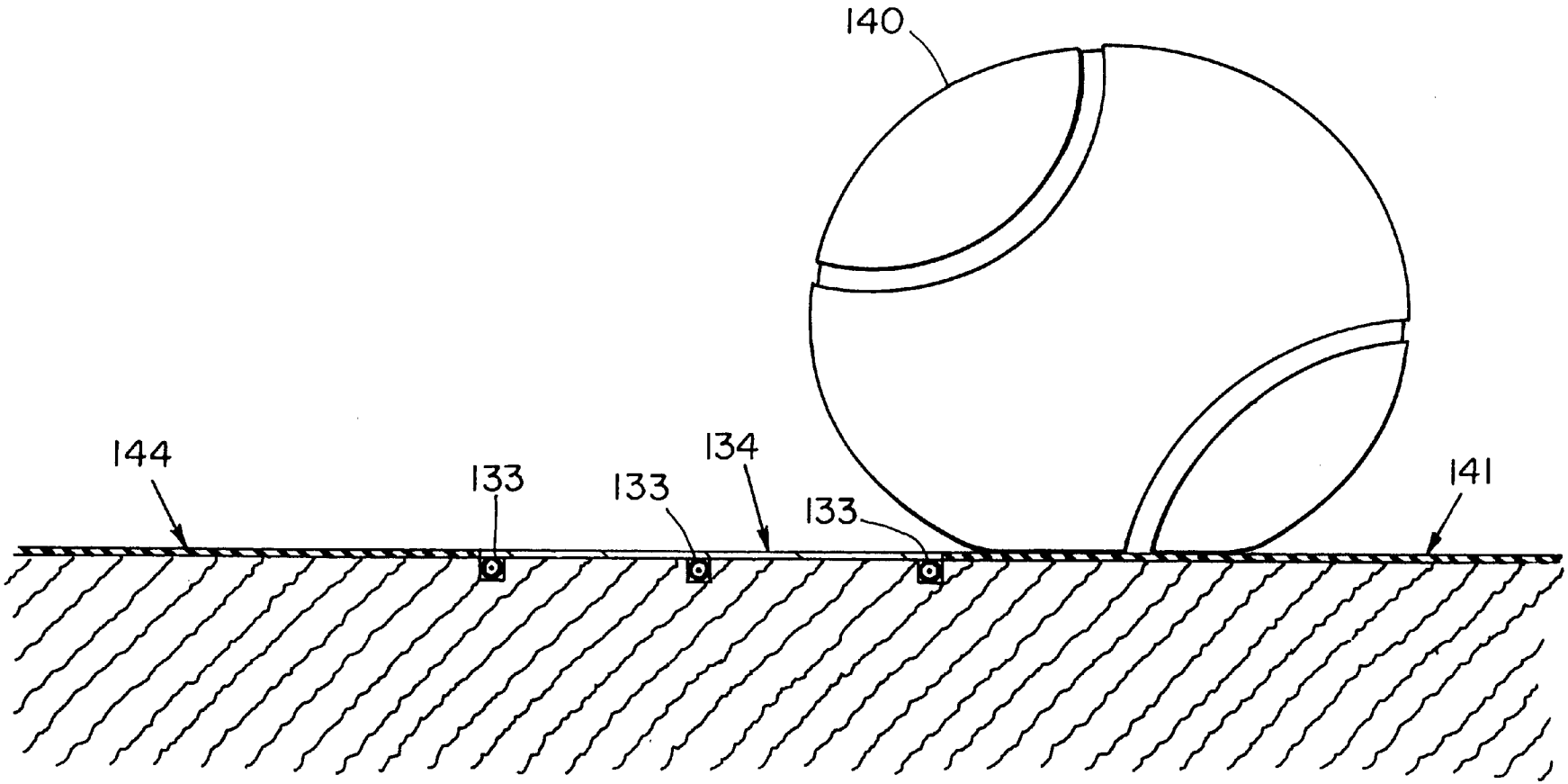
FIG. 9 depicts a cross-section view of a tennis ball bouncing in proximity to a boundary line, further showing the location of the pressure sensors.

When a ball bounces on a clay court it leaves a mark where it has touched the court. If this mark is not inside the box, the ball is considered to be "out" unless this mark touches the boundary line of the box, even if the compressed ball overhangs the boundary line as shown in FIG. 9. The ball 140 shown in FIG. 9 is "out" because even though it overhangs the boundary line 142, it touches only the "out" portion 141 of the court without touching either the boundary line 134 (shown here with the folded cable configuration 133 for a hard court) or the "in" portion of the court 144. When used with a hard court, the sensitivity of the contact sensors should be adjusted, to the extent possible, to indicate that a ball is "in" if the point of contact, degree of compression and skid or roll are such that, were the court a clay court, the mark created would have shown the ball to be "in".

Figure 10A:
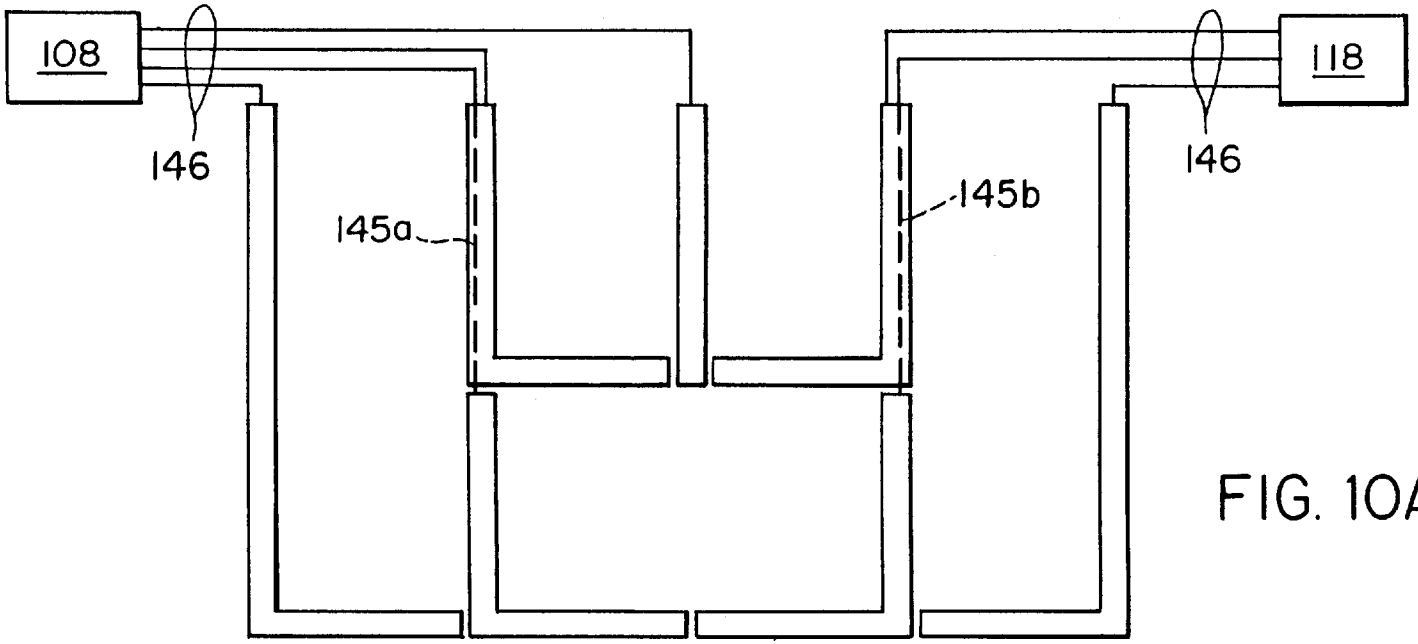
FIG. 10*a* depicts the interconnections of the cables with the distribution boxes on a standard tennis court, further showing the routing of cables beneath other cables on the court.
Figure 10C:
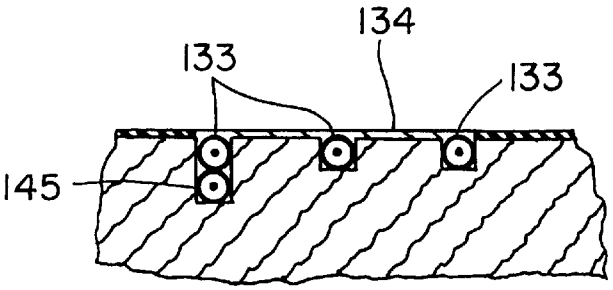
FIG. 10*c* depicts a cross section of a particulate-surface court, with the pressure-sensitive cables embedded in the court, further showing the routing of signals by cables beneath other cables on the court.
Figure 10B:
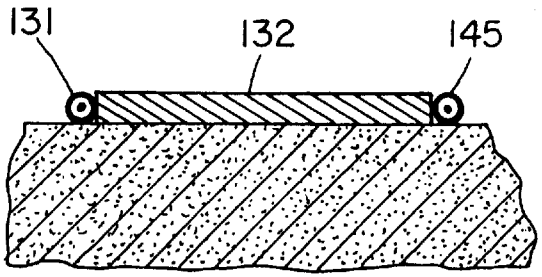
FIG. 10*b* depicts a cross section of a boundary line tape, with cables bonded to the inside and outside edges of the tape.

With both the clay court tape sensors and the folded cable sensors for other courts, a connecting cable continues from the area of the sensor to the line of the net and then along the base of the net to a cable concentrator assembly from which the signals are routed to the Computer Subsystem. When the sensor under consideration is used for a boundary segment which is not immediately adjacent to the line of the net, this connecting cable must cross through a logically distinct region of the court. It becomes important in this case that no signals can be created in the connecting cable which could be mistakenly interpreted as indicating that a ball was "in" when it was "out". This can be accomplished in alternate embodiments by making the connecting cable of non-piezoelectrically active material or by protecting it from impacts. In the preferred embodiment, the connecting cable is made of the same piezoelectrically active material as the sensor and is simply routed under or along another contiguous in-sensor which makes up another portion of the boundary of the same box and which adjoins the net. This can always be done because each box includes the line of the net as one edge. FIGS. 10*a* shows the preferred routing of connecting cables for in-sensors. FIGS. 10*b* and 10*c* show the detail of the relationship between this connecting cable 145*a* or 145*b* and such contiguous in-sensor for clay courts and other courts respectively. In the case of clay courts the connecting cable 145*a* or 145*b* may be bonded to the other edge of the tape 132 of such contiguous in-sensor and with other court types the connecting cable may be laid in a slightly deeper groove below one fold of the sensor cable of such contiguous in-sensor. For the flattened coaxial cable sensors, the connecting cable can be laid down directly below the contiguous in-sensor. Each sensor has a connecting cable 146 which is routed to the nearest cable concentrator box 108 or 118.

The electrical signal from each cable is received and stored continuously by the computer subsystem, but most of these signals are never used. The cable signals are used only when the computer determines (based on the microphone signals) that the ball bounced near a court boundary line. This carefully controlled use of cable signals virtually eliminates erroneous line calls due to player contact with the boundary lines. The nature of the signal generation process within a cable is such that merely standing on a cable (without a significant rapid change in the applied force) causes no signal to be generated and does not reduce the ability of the cable to generate a signal when simultaneously hit by a ball.

Moreover, the ability of a properly constructed coaxial cable to detect contact by a ball or other object, to generate a signal in response and to conduct said signal to the end of the cable is not materially diminished by increasing cable length so that cables having lengths of several hundred feet generate easily discernible signals in response to the slightest contact.

Microphone Subsystem

The Microphone Subsystem is used to detect the sound of ball bounces, racquet hits and net-cord hits. A theoretical minimum of three, but more practically six to ten, microphones are positioned at court level a safe and convenient distance outside the court boundaries and spaced around the court so that from any point on the court the three closest microphones lie in widely separated directions. The computer system constantly monitors the signals received from all microphones, detects and recognizes the sound of each ball bounce, and through calculations based on the relative time of arrival of the sound at the several microphones, estimates the location and time where the ball hit the court as well as the location and time of racquet hits and net-cord hits. An initial estimate can be made when signals have been received by the closest three microphones and the estimate can be refined as signals are received by additional microphones. If the estimated location is not close to a court boundary line, then in fully-automatic operation the ball can be called "in" or "out" based on the microphone signals alone. If the ball hits close to a boundary line then the stored cable signals are inspected, as discussed above, before a decision is made.

When used in supervised (i.e., tournament) play, the system need not make any calls. Instead it uses the microphone subsystem only to so restrict the intervals of time during which the computer system looks for signals from the cables (to verify if the bounce is in or out) that the probability of false indications due to contact by players with the cables is sufficiently small. Thus for supervised play the microphone subsystem need only allow the bounce position to be determined to an accuracy of a foot or two, because this distance corresponds to an uncertainty in the time of the ball bounce of one or two milliseconds or 0.1% of the roughly one second time between consecutive bounces. On the other hand, for unsupervised play, the microphone subsystem must provide for estimating the bounce position with an error less than the width of the boundary region covered by the cable subsystem—an allowable error of only a few inches, depending on the exact layout of the cable subsystem.

In supervised play the line judge monitoring a court boundary line is provided with a signal through an indicator light, earphone, or loudspeaker indicating that the line/cable subsystem sensed contact on the boundary line segment he is monitoring. In the case of an audible signal provided via the earphone or loudspeaker, the signal indication is either a beep or buzz or other sound.

In an alternative embodiment, this sound is produced by merely amplifying the signal generated in the appropriate segment of the line/cable subsystem, and filtering it to reduce the effect of electrical noise. The sound produced by this amplified sensor signal embodies the characteristics of level, duration, and spectral content of the original sensor signal which a linesman can be trained to recognize as due to a ball, foot step, or other object contacting the line/cable subsystem on the boundary line segment he is monitoring.

Speaker Subsystem

The Speaker Subsystem is used to measure the speed of sound and to correct for the effects of wind. The speakers are also used to make audible indications.

Estimation of the location of a ball bounce based on microphone signals depends not only on accurate knowledge of the position of each microphone but also on an accurate knowledge of the speed of sound in air. To be effective for unsupervised play, the required fractional accuracy is roughly equal to the ratio of a) the width of coverage of the contact sensors (in-sensors plus out-sensors, if used) associated with a boundary line to b) the distance of the ball bounce from the farthest microphone being used to estimate the location of the bounce. For example, if the width of coverage of the contact sensors is three inches and a microphone 60 feet away is used, then the speed of sound should be known to better than one part in $60\times12/3=240$ or roughly 0.4%. Since the speed of sound in air increases by almost 0.1% per degree Fahrenheit, modest changes in temperature can cause significant shifts in the estimate bounce location. If the temperature is uniform over the court, the temperature is easily measured and the speed corrected, but outdoor courts are subject to irregular heating due to sun and shade (so the sound speed may be different from place to place) and these differences may change over the duration of play with the relative motion of the sun and the passing of clouds.

In addition to the influence of temperature, wind can cause the effective speed of sound to increase in the direction of the wind and decrease against the wind. Since the speed of sound in air is roughly 700 miles per hour, the required accuracy of 0.4% implies a knowledge of the speed of the wind component along each sound path to an accuracy of better than $0.4\%\times700$ mph=2.8 mph. Moreover since the speed and direction of the wind may vary from time to time as well as from place to place on the court, the speed of sound must be measured at appropriate times along paths adequately representative of the paths that the sound has followed or will follow, at least in the case of bounces near the boundary lines. This can be accomplished either by incorporating small speakers connected to the cables at several places within the boundary lines or by positioning speakers at other places, e.g., near each microphone.

In the former case the speaker nearest the bounce point, or in the latter case all speakers collocated with microphones being used to estimate position, are caused to emit a calibration signal immediately after the bounce point has been located by the computer. In the case where a single speaker near the bounce point emits the calibration signal, the speed of sound can be measured directly over known paths close to the paths followed by the sound of the ball bounce. In the case where the speakers are collocated with the microphones, the distribution of sound speed over the court can be estimated by constructing a mathematical model of this distribution and then estimating the values of model parameters using well known estimation techniques. For example the effect of sun and shade might be modeled on each side of the net as a sunny region and a shady region on different sides of a straight line boundary. With this model three parameters define the position of the boundary and two parameters define the sound speed on either side of the boundary. The effect of wind might be modeled on each side of the net as a uniform translation of the air mass with two parameters to describe the air speed and direction. With these models, if four microphones are installed on either side of the net and sound speed calibration measurements are made in both directions between all pairs of microphones on the side of the net where the ball bounced, then 12 measured values would be available from which the seven parameters (five for temperature and two for wind) could be estimated.

In addition to their use in measuring sound speed, the speakers are used to provide audible indications when balls are determined to be "out" and to announce the score when automatic score keeping is used.

In the case of supervised tournament play, the required accuracy in estimating sound speed is considerably reduced. Moreover, audible announcements by the system might be suppressed and instead earphones might be provide for the linesmen to indicate that the system has detected that the linesman's line was touched during the brief interval that the microphone subsystem indicated that contact might have occurred.

Computer Subsystem

The Computer Subsystem consists of a 486 standard personal computer 122 together with analog filters which amplify and shape the microphone and cable signals; one or more analog-to-digital converters, which convert the analog signals to digital form, and one or more digital-to-analog converters which create the signals to be sent to the speakers and/or earphones. Threshold comparison logic hardware is also included to reduce the computer workload to determine when significant signals have been received from the microphones.

The filters, the analog to digital and digital to analog circuits are located in the signal processing unit 120. The memory which holds the digitized versions of all signals for several hundred milliseconds is located in the computer interface 121.

The computer subsystem, under control of the line-calling software 123, continuously stores the digitized signals received from all microphones and all cables. The microphone signals are inspected immediately when they arrive whereas the cable signals are stored and inspected only when necessary, that is, when the sound system determines that the ball has bounced close to one of the boundary lines, one foot being the approximate greatest distance which triggers an examination of the boundary line pressure sensors.

The computer subsystem, using the line-calling software 123 continuously monitors the signals received from the microphones and searches for sounds related to the ball. As everyone who has carefully listened to a tennis match knows, a ball bounce generates a characteristic "thump" sound, a racquet hit makes a "twang" sound and a ball or racquet hits the net with a "whack". In each of these cases the sound and the associated electrical waveform is very repeatable. The wave form resulting from net-cord hits is less repeatable or characteristic, but cable sensors in the net provide an unambiguous indication of a net-cord hit.

Although time-to-time variations exist, and although the exact details of the waveform depend on the choice of microphones, there are certain repeatable characteristics which can be used to recognize each sound. A ball bounce begins with one or two cycles of sinusoid at about one kilohertz followed by several decaying cycles at about 250 Hertz, with some higher harmonics, leading to the audible downshifting "thump" sound. A racquet hit sound starts with several cycles at around one kilohertz, followed by one cycle at around 250 Hertz (similar to a ball bounce) but then rather than continuing at this lower frequency, there are several decaying cycles at around one kilohertz leading to the upshifting "twang" sound.

Although these signal characteristics have been described in terms of frequencies, each frequency is present for only a few cycles so that normal frequency analysis is incapable of distinguishing the different types of events. A variety of computational embodiments are used to search for and recognize the sound of ball bounces.

In one such embodiment the computer continuously performs cross-correlation calculations between the signal from each microphone and a standard replica of each of the relevant sounds.

The preferred, less computationally demanding embodiment begins by searching for sudden increases in signal level generated by the microphones. All events involving the ball have rather sudden onsets, increasing from zero to significant levels within less than one millisecond, whereas many other common tennis court sounds (e.g., voices and shoe sounds) have slower onsets.

When a sound with a rapid onset is detected, in one embodiment the computer then performs cross-correlation calculations with replicas of the relevant sounds. The preferred embodiment of the waveform identification calculation uses the computationally less demanding technique of inspecting the waveform to determine the presence of the characteristic features described above. After detecting a signal with sudden onset, this involves searching for maxima and minima that define the cycles of the signal as described above.

In addition to detecting and identifying significant sounds picked up on each microphone, the computer uses the difference in time of arrival of the sounds at several microphones in order to estimate the location and time of the event generating the sound.

With microphones placed around the periphery of a 60 foot by 120 foot playing surface, a ball sound arrives at the several microphones after a range of different delays. With eight microphones the sound arrives at the closest microphone within between zero and 40 milliseconds and at the farthest microphone not later than 100 milliseconds after the event. Depending on the placement of microphones, a more typical maximum spread (earlier to latest) of arrive times is 70 to 80 milliseconds, whereas the time between consecutive events involving the ball (e.g., between bounce and hit) is on the order of 100 to several hundred milliseconds. Thus the sound of a given event usually arrives at all microphones and almost always arrives at the four closest microphones before the sound of the next event arrives at any microphone.

Some exceptions to the timing described in the above paragraph occur when a half volley is struck. In this case there is a very short time between when the ball bounces on the court and when it is struck with the racquet. Similarly a short time difference occurs when a ball is hit into the net at close range. In both of these cases the time between the two events could be arbitrarily small in principle but in practice the time is rarely less than 30 or 40 milliseconds, but even in these cases, because sound travels much faster than the ball, the order of arrival of all sounds is the same at each microphone. The computer must associate corresponding sounds from the several microphones in order to make proper estimates of the location and time of each event.

In determining the correct associations the computer must observe several constraints:

1) if the sound from each microphone has been classified properly, all sounds should all be of the same type (e.g. all ball bounces or all racquet hits);
2) the order of arrival of each sound is the same at each microphone;
3) the relative times of arrival at the several microphones should be consistent with the relative distances from some point on or near the court (incorrect associations often lead to apparent relative arrival times which could not result from any location or are hundreds of feet from the court);

4) the time and distance between consecutive events should be consistent with a ball traveling at reasonable speed between the two estimated locations in the estimated time.

Figure 11:
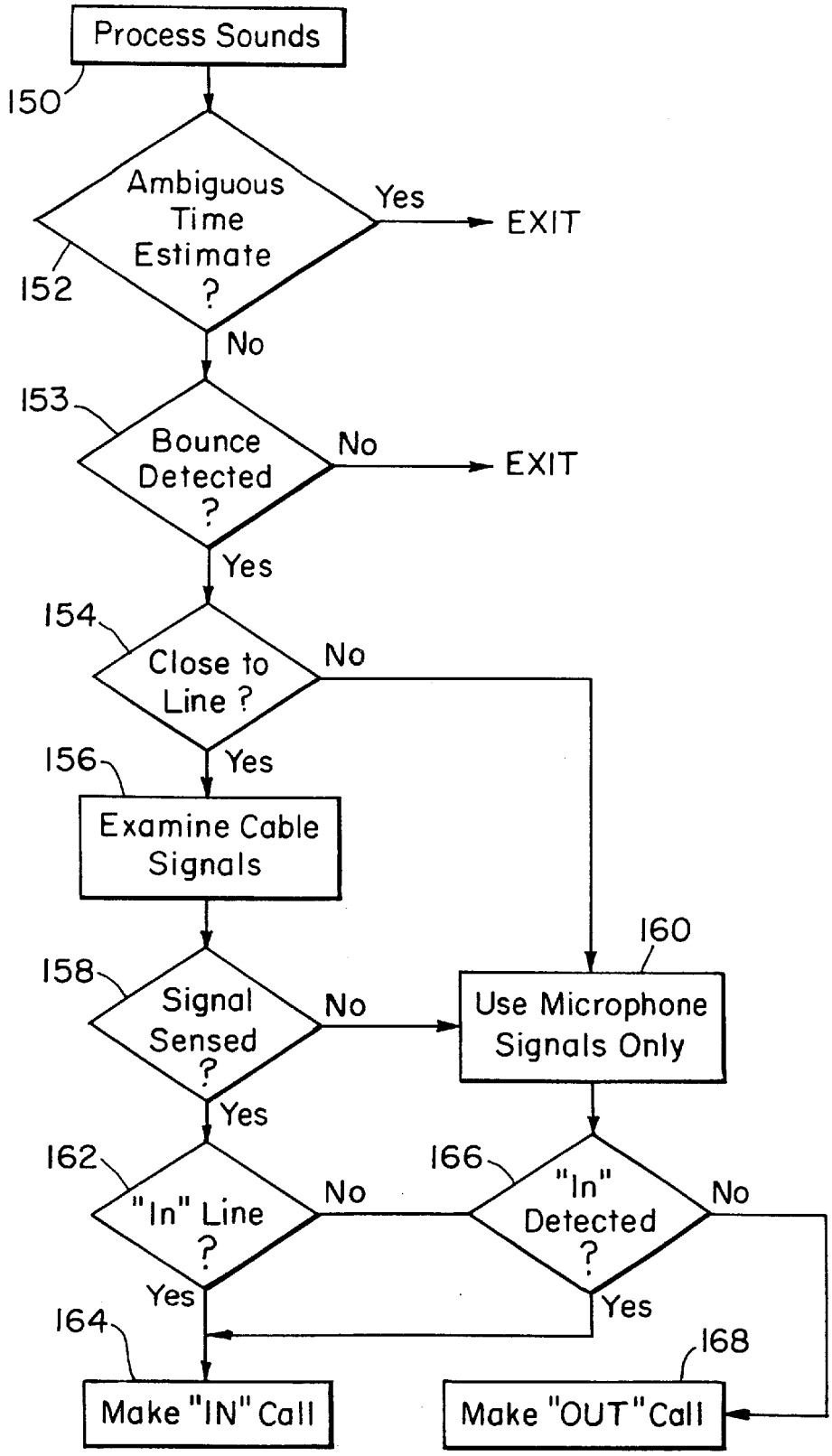
FIG. 11 depicts a flow diagram showing the logic of the detection system, combining the measurement by the sound subsystem and detection by the pressure-sensing subsystems.

When the computer has made an acceptable association of sounds from a sufficiently large number of microphones to make a position and time estimate, several tests are then made, as shown in the logic diagram of FIG. 11. At least three microphones are required for the unambiguous location and time estimate, and preferably four to six are used.

Referring to FIG. 11, the sounds are processed 150 to determine if an unambiguous location and time estimate is made 152. If so, if the sound is recognized as a bounce 153, then a test is made to determine if the estimated bounce location is closer to a court boundary line segment than the known uncertainty of the position estimate 154. If so, then the computer inspects the signals previously stored at the estimated time of the bounce from the cable(s) associated with that boundary line segment 156. If the ball caused a signal to be generated in one or more cables at the estimated time of the bounce 158, this information is treated differently depending on the type of sensor which detected the signal. If an in-sensor cable detected contact 162, then the ball is called "in" 164. If an out-sensor cable detected contact, then the closest in-sensor is checked for simultaneous contact 166. If this in-sensor detected contact simultaneously or within the roughly one to three milliseconds it might take a ball to travel between the sensors (usually the in-sensor is first), then the ball is called "in" 164 and otherwise is called "out" 168. If no cable signals were generated within the interval of the error limits of the time estimate (plus the roughly two millisecond compression time of the ball), the ball is called "in" or "out" based on the microphone signals only 160.

Because the only cable signals which are used are those arising during a brief interval of time, the likelihood of erroneous "in" or "out" calls due to a player stepping on a cable or hitting a cable with a racquet is almost negligible.

In an embodiment which provides still greater immunity to interference by players, the cables associated with the boundary line segments enclosing the "in" region of the court can be divided into electrically isolated sub-segments so that the cables in the sub-segment being checked by the computer are not affected by player contact with another sub-segment even on the same boundary line.

Control/Display Subsystem

The automatic line calling system is controlled through the computer keyboard or mouse. After receiving initial information specifying whether the tennis match is to be singles or doubles, which side is to serve first, whether tie breakers are to be played, etc., the computer can monitor the progress of play, make line call decisions, announce the calls (visually, audibly or both) and maintain and announce the score. Corrections to calls and to the score (when situations arise which the line calling system cannot sense) are also made using the keyboard, mouse or any other suitable means for computer data entry.

The automatic line calling system of this invention can also call foot faults on serves. Although previous inventions have disclosed the calling of foot faults by using a contact sensor at the baseline to detect a server's foot contacting the court combined with a one or more microphones to detect the sound of the server's racquet hitting the ball, such an approach is somewhat imprecise because it does not take into account the propagation time of the sound to the microphone from the place where the racquet hit the ball—a time that might be on the order of 20 milliseconds or more depending on the placement of the microphone. This invention routinely detects and determines the spatial positions and time of origin of sound sources, including racquet hits, and can detect contact with the cable sensors (including foot contact) and compare the time of two such events to within a resolution of less than one millisecond.

In the case of supervised tournament play, the system need not keep score but must only indicate to the linesmen and chair umpire that the ball bounced on a line.

Alternative Sensor Constructions

Figure 12A:
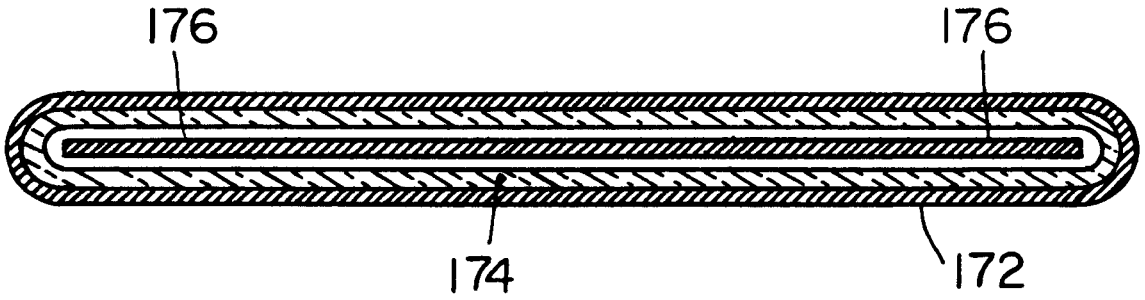
FIG. 12*a* depicts a cross section of the flattened coaxial cable with a flattened center conductor.

In alternative embodiments, the flattened coaxial cable previously disclosed and described may take one of several forms. In FIG. 12*a,* the cross section of the first such embodiment shows a flattened outer shield 172, surrounding a flattened dielectric, 174, and containing a flattened center conductor 176.

Figure 12B:
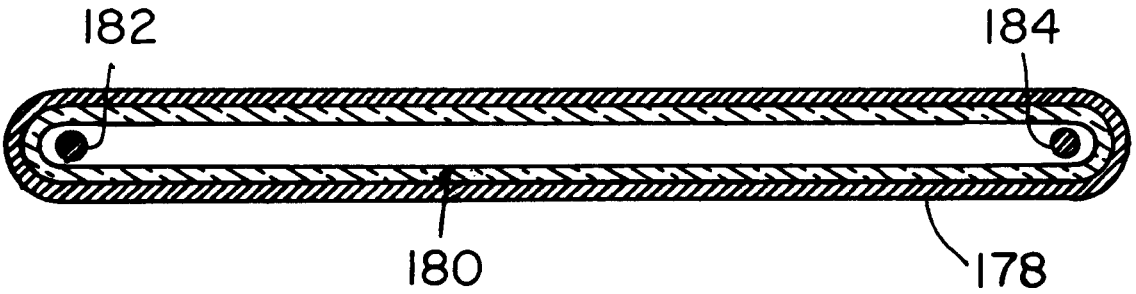
FIG. 12*b* depicts a flattened coaxial cable with two round center conductors.

FIG. 12*b* shows an alternative construction which comprises a similarly flattened shield 178 and flattened dielectric 180. However, in the alternative of FIG. 12*b* the flattened center conductor is replaced by two round center conductors 182 and 184, in the form of small-diameter round wires. Other embodiments comprise flattened cables with flattened dielectrics and a multiplicity of small-diameter -round-wire center conductors. The form of the cable and number and shape of center conductors determines the cost of manufacturing of the cable, as well as the sensitivity of the cable measured as the voltage produced at the cable end when the cable is struck by a tennis ball.

The embodiments previously described utilize single cables to sense the edges of a standard tennis court boundary line. However, alternative embodiments teach the use of folded narrow cable configuration to produce the same result as a single wide cable. FIG. 8*c* shows a shows a cable which is "folded" by running it back and forth in parallel lines. It is required that the distance between adjacent lines is sufficiently small so that a tennis ball may not strike between two adjacent lines without touching at least one of them, and thus inducing a voltage thereby. Using this technique, a folded line may be constructed so as to effect a detector of any effective width desired. This folding technique may be used with flattened cables, or with multi-center conductor cables, as well as with round cables.

Embodiment Omitting Microphone Subsystem

When used in supervised (i.e. tournament) play where a line judge is available to monitor each line as is now the common practice, the reduction in the accuracy requirement on the microphone subsystem as previously discussed above can be more extreme even to the limiting case of eliminating the microphone subsystem altogether.

In this alternative embodiment the Microphone subsystem is omitted entirely, and the line judge monitoring a court boundary line is provided with a signal indication via an indicator light, earphone, or loudspeaker, as describe above in the paragraphs entitled "Microphone Subsystem". The occurrence of such indication is essentially simultaneous with his visual observation of a ball hitting in proximity to that line.

The availability of this audio signal has been shown to enhance the line-caller's ability to accurately determine when the ball has struck a boundary line or not. In addition, experiments have shown that the sounds produced by the coaxial cables when struck by a tennis ball are easily distinguished from the sounds produced by other objects striking the cables. In particular, the sounds produced by the players walking or running across the lines are easily differentiated from sounds resulting from ball bounces.

Embodiment Omitting Line/Cable Subsystem

An alternative embodiment omits the line/cable subsystem from the system of the preferred embodiment.

In the preferred embodiment the Computer Subsystem relies primarily on the Microphone Subsystem in determining whether a particular acoustic event is a ball bounce, a racquet hit, a net hit, or some other event. The computer also computes the time and approximate location on the playing field of each such event. In said preferred embodiment the Computer Subsystem uses the signals produced by the Line/Cable Subsystem to confirm and to adjust slightly the computed estimate of the location of ball bounces which are close to a boundary line.

Thus, when used only for gathering data and statistics on player performance for player training as previously discussed, where fractional-inch accuracy in the location of ball bounces is not necessary, the line/cable subsystem may be omitted.

In this alternative embodiment the line/cable subsystem is not present. As a result the installation of this alternative is much less expensive than the preferred embodiment, and provides reasonable accuracy for applications outside of competitive environments.

While the invention has been described with reference to specific embodiments, it will be apparent that improvements and modifications may be made within the purview of the invention without departing from the scope of the invention defined in the appended claims.

We claim:

1. An apparatus for automatically determining whether a ball is in or out of play in a game played on a field of play in which the ball strikes within or without boundaries demarcated by boundary lines, comprising:

a multiplicity of elongated pressure-sensitive devices located parallel to, and in proximity with the boundary lines, wherein, in response to a change in pressure, each pressure sensitive device produces an electrical pressure signal;

a multiplicity of sound-sensitive devices spaced around the periphery of the field of play, wherein each such device produces an electric sound signal in response to a sound;

means for processing the sound signals to produce approximate location information of the ball;

means for processing said approximate location information together with said pressure signals to determine a precise location of the ball;

whereby the apparatus is able to determine, to a high degree of accuracy, where the ball strikes various objects including the field of play, and whether a ball is in or out of play.

2. The apparatus of claim 1, wherein the game is tennis, the ball is struck with a racquet, and the field of play is a standard tennis court incorporating a net separating the two halves of the court.

3. The apparatus of claim 2, wherein the pressure-sensitive devices comprise coaxial cable.

4. The apparatus of claim 3, whereby the multiplicity of pressure-sensitive devices are arranged in lines parallel to the boundary lines and in close proximity to the boundary lines, and the pressure-sensitive devices spaced so as to assure contact between the ball and the pressure-sensitive devices when the ball hits near the boundary lines.

5. The apparatus of claim 4 wherein the parallel arrangement of the pressure-sensitive devices is formed by a single such elongated pressure-sensitive device which is arranged as a multiplicity of contiguous segments wherein each successive segment is folded back and laid parallel to the previous segment.

6. The apparatus of claim 3, wherein the boundary lines comprise tapes fastened to the court; and the coaxial cables are bonded to the tapes.

7. The apparatus of claim 3, wherein the pressure-sensitive devices comprise commercially available coaxial cables.

8. The apparatus of claim 7, wherein the coaxial cables are of the generally commercially available type RG174.

9. The apparatus of claim 3, wherein the coaxial cables are flattened to be very thin and roughly the width of a standard boundary line tape.

10. The apparatus of claim 3, wherein the coaxial cables are flattened to be very thin.

11. The apparatus of claim 2, further comprising one or more pressure-sensitive devices affixed to the net for detecting net-cord hits, whereby the pressure-sensitive devices produce electrical signals when the net is struck, and whereby said electrical signals are processed together with the electrical signals produced by the sound-sensitive devices and by the boundary-line pressure-sensitive devices to determine the location of the ball.

12. The apparatus of claim 2, wherein the sound sensitive devices are microphones.

13. The apparatus of claim 12, wherein the means for calculating the location of the ball striking the court comprise time delay means.

14. The apparatus of claim 13, wherein the time delay means further comprise interferometric means.

15. The apparatus of claim 13, further comprising:

a multiplicity of loudspeakers, a loudspeaker located in close proximity to each sound-sensitive device; and means for processing the signals from each loudspeaker, together with the signals produced by the sound-sensitive devices and the signals produced by the pressure-sensitive devices, whereby the system may be calibrated thereby.

16. The apparatus of claim 12, wherein the means for processing the electrical signals produced by the sound sensitive means further comprises means for analyzing the signals to distinguish between sounds of balls striking the court and all other sounds.

17. The apparatus of claim 12, wherein the means for processing the electrical signals produced by the sound sensitive means further comprises means for analyzing the signals to distinguish between sounds of balls striking the racquet and all other sounds.

18. The apparatus of claims 16 or 17, whereby the means for analyzing the signals to distinguish between sounds of balls striking the court, balls striking the racquet, and all other sounds comprises waveform analysis means.

19. The apparatus of claim 18, further comprising:

means for calculating the game score from the signal output by the means for calculating the location of the ball striking the court, the racquet, and the net; and means for providing output of the game score thus calculated.

20. The apparatus of claim 19, further comprising:

means for collecting and storing statistical data from the signal output by the means for calculating the location of the ball striking the court, the racquet, and the net; and means for providing output of the statistical data thus collected and stored.

21. The apparatus of claim 20, wherein the means for collecting, storing, calculating and providing output of statistical data comprises a personal computer.

22. The apparatus of claim 19, wherein the means for calculating and providing output of the game score comprises a personal computer.

23. The apparatus of claim 19, wherein the means for providing output of the game score comprises one or more loudspeakers.

24. A method for automatically determining whether a ball is in or out of play in a game played on a field of play in which the ball strikes within or without boundaries demarcated by boundary lines, comprising:

attaching a multiplicity of elongated pressure-sensitive devices located parallel to, and in proximity with the boundary lines, wherein, in response to a change in pressure, each pressure sensitive device produces an electrical pressure signal;

locating a multiplicity of sound-sensitive devices spaced around the periphery of the field of play, wherein each such device produces an electric sound signal in response to a sound;

processing the sound signals to produce approximate location information of the ball; and processing said approximate location information together with said pressure signals to determine a precise location of the ball.

25. The method of claim 24, wherein the game is tennis, the ball is struck with a racquet, and the field of play is a standard tennis court incorporating a net separating the two halves of the court.

26. The method of claim 25, further comprising arranging the multiplicity of pressure-sensitive devices parallel to and in proximity with the boundary lines in parallel lines and spacing said pressure-sensitive devices so as to assure contact between the ball and the pressure-sensitive devices when the ball hits near the boundary lines.

27. The method of claim 25, further comprising affixing one or more pressure-sensitive devices affixed to the net for detecting net-cord hits, whereby the pressure-sensitive devices produce electrical signals when the net is struck; and processing said electrical signal together with the electrical signals produced by the sound-sensitive devices and by the boundary-line pressure-sensitive devices;

whereby the location of the ball may be accurately determined.

28. The method of claim 25, wherein the boundary lines are tapes affixed to the court, and further comprising bonding the pressure-sensitive device to the boundary lines.

29. The method of claim 25, wherein the sound sensitive devices are microphones.

30. The method of claim 29, wherein calculating the location of the ball striking the court comprises measuring of time delays.

31. The method of claim 30, wherein the measuring of time delays further comprise measuring by interferometry.

32. The method of claim 29, further comprising storing the electrical outputs of each of the pressure-sensitive devices and the time of each such output;

determining whether the location of the ball striking the court, as calculated by means of said sound-sensitive devices, is close to any boundary lines;

if said location is close to a boundary line, then determining whether there is any stored output of the pressure-sensitive device corresponding to said boundary line, and if so, then using said stored signal to determine whether the ball was in play or out of play; and if said location is not close to a boundary line, then determining the location of the ball strking the court by sound-sensitive means alone.

33. The method of claim 29, further comprising:

locating a loudspeaker in close proximity to each microphone;

generating test signals;

outputting the test signals to the loudspeakers;

detecting the arrival of the sound produced by the loudspeakers as a result of the test signals at each of the microphones; and measuring the time delay from each such loudspeaker to each such microphone, whereby said time delays are used to calibrate the calculations used in processing the signals to determine the location of the ball.

34. The method of claim 29, wherein processing the electrical signals produced by the sound sensitive means further comprises analyzing the signals to distinguish between sounds of balls striking the court, and all other sounds.

35. The method of claim 29, wherein processing the electrical signals produced by the sound sensitive means further comprises analyzing the signals to distinguish between sounds of balls striking the racquet and all other sounds.

36. The method of claims 34 or 35, whereby analyzing the signals to distinguish between sounds of balls striking the court, balls striking the racquet, and all other sounds comprises analyzing the waveforms of the signals.

37. The method of claims 30, 32, 33, 34, or 35, further comprising using a computer program for processing the signals to determine the location of the ball.

38. The method of claim 37, further comprising displaying information on a computer video display terminal in order to effect the providing output of the score.

39. The method of claim 37, further comprising generating audible sound alarms in order to effect the providing output.

40. The method of claim 37, further comprising:

using a computer program for:

determining the sequence of ball strikes, net-cord hits, and racquet hits and the locations on the court in which these events take place;

storing said sequences;

inputting and storing the rules of the game of tennis;

calculating the score of the tennis match; and providing output of said score.

41. The method of claim 40, further comprising:

collecting statistical date from the determinations of the events recounted in claim 40;

formatting said statistical data; and providing output of said statistical data.

42. An apparatus for automatically determining the source and the time of occurrence and location of a sound-producing event on a field of play in a ball game, comprising:

a multiplicity sound-sensitive devices spaced around the periphery of the field of play, wherein each such sound sensitive device produces an electric signal in response to a sound detected in the air; and means for processing the electrical signals produced by the sound-sensitive devices to determine service and the location and time of occurrence of the sound-producing event;

whereby the apparatus is able to determine, to a high degree of accuracy, where the ball strikes various objects including the field of play, or whether a ball is in or out of play.

43. The apparatus of claim 42, wherein the game is tennis, the ball is struck with a racquet, and the field of play is a standard tennis court incorporating a net separating the two halves of the court.

44. The apparatus of claim 43, wherein the sound sensitive devices are microphones.

45. The apparatus of claim 44, wherein the means for calculating the location of the sound-producing event comprise time delay means.

46. The apparatus of claim 45, wherein the time delay means further comprise interferometric means.

47. The apparatus of claim 45, further comprising:

a multiplicity of loudspeakers, a loudspeaker located in close proximity to each sound-sensitive device; and means for processing the signals from each loudspeaker, together with the signals produced by the sound-sensitive devices, whereby the system may be calibrated thereby.

48. The apparatus of claim 44, wherein the means for processing the electrical signals produced by the sound sensitive means further comprises means for analyzing the signals to distinguish between sounds of balls striking the court and all other sounds.

49. The apparatus of claim 44, wherein the means for processing the electrical signals produced by the sound sensitive means further comprises means for analyzing the signals to distinguish between sounds of balls striking the racquet and all other sounds.

50. The apparatus of claims 48 or 49, whereby the means for analyzing the signals to distinguish between sounds of balls striking the court, balls striking the racquet, and all other sounds comprises waveform analysis means.

51. The apparatus of claim 50, further comprising:

means for calculating the game score from the signal output by the means for calculating the location of the ball striking the court, the racquet, and the net; and means for providing output of the game score thus calculated.

52. The apparatus of claim 51, wherein the means for calculating and providing output of the game score comprises a personal computer.

53. The apparatus of claim 51, wherein the means for providing output of the game score comprises one or more loudspeakers.

54. The apparatus of claim 50, further comprising:

means for collecting and storing statistical data from the signal output by the means for calculating the location of the ball striking the court, the racquet, and the net; and means for providing output of the statistical data thus collected and stored.

55. The apparatus of claim 54, wherein the means for collecting, storing, calculating and providing output of statistical data comprises a personal computer.

56. An apparatus for assisting line judges in determining whether a ball is in or out of play on a tennis court in which the boundaries of play are demarcated by boundary lines, comprising:

a multiplicity of coaxial cables located parallel to, and in proximity with the boundary lines, wherein each cable produces an electrical signal in response to a change of pressure on said cable;

means for processing the electrical signals produced by the coaxial cables to provide an indication to said line judges when a coaxial cable is struck by a ball whereby the line judge is able to determine, to a high degree of accuracy, whether the ball strikes the court contemporaneously with the occurrence of said indication.

57. The apparatus of claim 56, wherein the coaxial cables comprise commercially available coaxial cables.

58. The apparatus of claim 57, wherein the coaxial cables are of the generally commercially available type RG174.

59. The apparatus of claim 56, wherein the coaxial cables are flattened to be very thin.

60. The apparatus of claim 56, whereby the multiplicity of coaxial cables are arranged in lines parallel to, and in close proximity to the boundary lines, and the coaxial cables spaced so as to assure contact between the ball and said cables when the ball hits near the boundary lines.

61. The apparatus of claim 56, wherein the parallel arrangement of the coaxial cables is formed by a single cable which is arranged as a multiplicity of contiguous segments wherein each successive segment is folded back and laid parallel to the previous segment.

62. The apparatus of claim 56, wherein the boundary lines comprise tapes fastened to the court; and the coaxial cables are bonded to the tapes.

63. The apparatus of claim 56, further comprising one or more coaxial cables affixed to the net for detecting net-cord hits, whereby the coaxial cables produce electrical signals when the net is struck, and whereby said electrical signals are processed, together with the electrical signals produced by the other coaxial cables of the apparatus, to produce said indication.

64. The apparatus of claim 63, wherein the indication is an audible sound generated by amplifying and filtering the electrical signal.

65. An apparatus for use during tennis play, comprising:

one or more coaxial cables attached to the net, wherein each cable produces an electrical signal in response to a change of pressure on said cable;

means for processing the electrical signals produced by the coaxial cables; and means for providing an indication from said processed signal, whereby said indication may be used to determine whether or not the ball has struck the net.

66. The apparatus of claim 65, wherein the processing further comprises level detection.

67. The apparatus of claim 66, wherein the indication comprises an audible output.

* * * * *